US007255724B2

(12) United States Patent
Larsson et al.

(10) Patent No.: US 7,255,724 B2
(45) Date of Patent: Aug. 14, 2007

(54) METAL POWDER COMPOSITION AND PREPARATION THEREOF

(75) Inventors: Mats Larsson, Ängelholm (SE); Åsa Ahlin, Höganäs (SE); Maria Ramstedt, Helsingborg (SE); Hilmar Vidarsson, Höganäs (SE)

(73) Assignee: Höganäs AB, Höganäs (SE)

( * ) Notice: Subject to any disclaimer, the term of this patent is extended or adjusted under 35 U.S.C. 154(b) by 207 days.

(21) Appl. No.: 11/012,348

(22) Filed: Dec. 16, 2004

(65) Prior Publication Data

US 2005/0139039 A1 Jun. 30, 2005

Related U.S. Application Data

(60) Provisional application No. 60/543,278, filed on Feb. 11, 2004.

(30) Foreign Application Priority Data

Dec. 22, 2003 (SE) ..... 0303453

(51) Int. Cl.
*B22F 1/02* (2006.01)

(52) U.S. Cl. ..... 75/252

(58) Field of Classification Search ..... 75/252; 419/30

See application file for complete search history.

(56) References Cited

U.S. PATENT DOCUMENTS 4,483,905 A 11/1984 Engström
4,676,831 A 6/1987 Engström
4,834,800 A 5/1989 Semel
5,290,336 A 3/1994 Luk
5,298,055 A 3/1994 Semel et al.
5,368,630 A 11/1994 Luk
5,480,469 A 1/1996 Storstrom et al.
5,782,954 A * 7/1998 Luk ..... 75/252
6,280,683 B1 8/2001 Hendrickson et al.
6,464,751 B2 10/2002 Uenosono et al.
6,533,836 B2 3/2003 Uenosono et al.
6,602,315 B2 8/2003 Hendrickson et al.

* cited by examiner

*Primary Examiner*—Roy King
*Assistant Examiner*—Ngoclan T. Mai
(74) *Attorney, Agent, or Firm*—Buchanan Ingersoll & Rooney PC

(57) ABSTRACT

The invention concerns an improved segregation-resistant and dust-resistant metallurgical composition for making compacted parts, comprising at least about 80 percent by weight of an iron or iron-based powder; at least one alloying powder; and (c) about 0.05 to about 2 percent by weight of a binding/lubricating combination of polyethylene wax and ethylene bis-stearamide, the polyethylene wax having a weight average molecular weight below about 1000 and a melting point below that of ethylene bis-stearamide, and being present in amount between 10 and 90% by weight of the binding/lubricating combination.

20 Claims, No Drawings

METAL POWDER COMPOSITION AND PREPARATION THEREOF

The benefit is claimed under 35 U.S.C. §119(a)-(d) of Swedish Application No. 0303453-5, filed Dec. 22, 2003, and under 35 U.S.C. §119(e) of U.S. Provisional Application No. 60/543,278, filed Feb. 11, 2004.

FIELD OF THE INVENTION

The present invention relates to a new metal powder composition for the powder metallurgical industry. Particularly the invention relates to an iron-based powder composition which contains a binding composition which also provides lubrication during the compaction process used to form a part.

BACKGROUND OF THE INVENTION

In industry the use of metal products manufactured by compacting and sintering iron-based powder compositions is becoming increasingly widespread. The quality requirements of these metal products are continuously raised, and as a consequence new powder compositions having improved properties are developed. One of the most important properties of the final, sintered products is the density and dimensional tolerances, which above all have to be consistent. Problems with size variations in the final product often originates from inhomogenities in the powder mixture to be compacted. These problems are especially pronounced with powder mixtures including pulverulent components, which differ in size, density and shape, a reason why segregation occurs during the transport, storage and handling of the powder composition. This segregation implies that the composition will be non-uniformly composed, which in turn means that parts made of the powder composition are differently composed and consequently have different properties. A further problem is that fine particles, particularly those of lower density such as graphite, cause dusting in the handling of the powder mixture.

The small particle size of additives also create problems with the flow properties of the powder, i.e. the capacity of the powder to behave as a free-flowing powder. An impaired flow manifests itself in increased time for filling dies with powder, which means lower productivity and an increased risk of variations in density in the compacted component, which may lead to unacceptable deformations after sintering.

Attempts have been made at solving the problems described above by adding different binding agents and lubricants to the powder composition. The purpose of the binder is to bind firmly and effectively the small size particles of additives, such as alloying components, to the surface of the base metal particles and, consequently, reduce the problems of segregation and dusting. The purpose of the lubricant is to reduce the internal and external friction during compaction of the powder composition and also reduce the ejection force, i.e. the force required to eject the finally compacted product from the die.

Various organic binding agents are disclosed in for example the U.S. Pat. No. 4,483,905 (Engstrom) which teaches the use of a binding agent that is broadly described as being of "a sticky or fat character". The U.S. Pat. No. 4,676,831 (Engstrom) discloses the use of certain tall oils as binding agents. Furthermore the U.S. Pat. No. 4,834,800 (Semel) discloses the use of certain film-forming polymeric resins that are insoluble or substantially insoluble in water as binding agents.

Other types of binding agents set forth in the patent literature are polyalkylene oxides having molecular weights of at least about 7000, which are disclosed in the U.S. Pat. No. 5,298,055 (Semel). Combinations of dibasic organic acid and one or more additional components such as solid polyethers, liquid polyethers, and acrylic resins as binding agents are disclosed in the U.S. Pat. No. 5,290,336. Binding agents that can be used with high temperature compaction lubricants are disclosed in the U.S. Pat. No. 5,368,630 (Luk).

Furthermore, the U.S. Pat. No. 5,480,469 (Storström) provides a brief review of the use of binding agents in the powder metallurgy industry. The patent notes that it is important to have not only a powder composition that has the alloying powder adhered to the iron-based powder by way of the binding agent, but to also have a lubricant present to achieve adequate compressibility of the powder composition within the die and to decrease the forces required to remove the part from the die.

Specifically, the U.S. Pat. No. 5,480,469 teaches a method for binding additives in an iron-based powder metallurgical mixture to the iron or iron-based powder particles by the use of a diamide wax binder. In order to achieve an effective binding between the iron or iron-based particles and the additive particles the powder metallurgical mixture including the binder is mixed and heated to about 90-160° C. during mixing and melting of the binder, and subsequently the mixture is cooled during mixing, until the binder has solidified. By this method the flow and apparent density is substantially improved and the problem with dusting can be reduced or eliminated.

A property of a powder mix which is not specifically discussed in the U.S. Pat. No. 5,480,469 is the lubricating property. This property is of particular importance when components having high density and/or a complex shape are required. In connection with the production of such components it is essential that the lubricating properties of the used powder metallurgical mixture are good which in turn means that the energy needed in order to eject to component from the die, i.e. the ejection energy, should be low which is a pre-requisite for a satisfactory surface finish of the ejected component, i.e. a surface finish without any scratches or other defects.

We have now developed a new iron or iron based composition which is distinguished by low segregation and low dusting, good flow and high apparent density and which is also distinguished by good lubricating properties i.e. properties which are all important for powders to be compacted and sintered to high quality products.

SUMMARY OF THE INVENTION

In brief the iron or iron-based composition according to the present invention includes at least about 80 percent by weight of an iron or iron-based powder; at least one alloying powder in an amount up to 20 percent by weight; and about 0.05 to about 2 percent by weight of a combination of polyethylene wax and ethylene bisstearamide. The polyethylene wax should have a weight average molecular weight below about 1000 and a melting point below that of ethylene bisstearamide. Furthermore, the amount of the polyethylene wax should vary between 10 and 90% by weight of the total weight of the binding/lubricating combination of polyethylene wax and ethylene bisstearamide. In the powder composition used for compaction the polyethylene wax is present as a layer or coating on the iron or iron-based particles and binds the alloying element particles and the ethylene bisstearamide particles to the iron or iron-based particles. It is preferred that the composition also includes a fatty acid and a flow agent. The invention also concerns a method of preparing the powder composition to be compacted.

DETAILED DESCRIPTION OF THE INVENTION

As used in the description and the appended claims, the expression "iron or iron-based powder" encompasses powders prepared by atomisation, preferably water atomisation. Alternatively, the powder may be based on sponge iron. The powders may be essentially pure iron powders preferably such powders, which have high compressibility. Generally, such powders have a low carbon content, such as below 0.04% by weight. Other examples of powder are iron powders that have been pre-alloyed or partially alloyed with other substances improving the strength, the hardening properties, the electromagnetic properties or other desirable properties of the end products. Examples of powders are e.g. Distaloy AE, Astaloy Mo and ASC 100.29, all of which are commercially available from Höganäs AB, Sweden.

The particle size of the iron or iron-based particles normally have a maximum weight average particle size up to about 500 microns; more preferably the particles will have a weight average particle size in the range of about 25-150 microns, and most preferably 40-100 microns.

Examples of alloying elements are copper, molybdenum, chromium, nickel, manganese, phosphorus, carbon in the form of graphite, and tungsten, which are used either separately or in combination. These additives are generally powders having a smaller particle size than the base iron powder and most additives have a particle size smaller than about 20 μm.

The molecular weight of polyethylene wax has an impact on the powder properties and it has been found that a combination of good flow, high apparent density and low ejection energy may be obtained with a low molecular weight polyethylene which in connection with the present invention means a linear polyethylene having a weight average molecular weight below 1000, particularly below 800 and above 300 particularly above 400. In addition to the molecular weight of the polyethyelene wax the ratio between the ethylene bis stearamide and the polyethylene wax influences these properties. Ethylene bis stearamide is available as e.g. Acrawax® or Licowax®. Polyethylene wax is available from Allied Signal and Baker Petrolite.

According to the present invention and as is illustrated by the examples the relative amounts of polyethylene wax and ethylene bisstearamide are important. In the binding/lubricating combination of polyethylene wax and ethylene bisstearamide it has thus been found that 10-90% by weight should be polyethylene wax. According to the presently most preferred embodiment the amount of polyethylene wax should be present in 20-70% by weight of the binding/lubricating combination. If more than 90% by weight of polyethylene wax is used, the lubrication will be in most cases insufficient and if more than 90% by weight of ethylene bisstearamide is used, the binding will be insufficient. The total amount of binding/lubricating combination in the composition is preferably between 0.5 and 1% by weight.

The improved segregation-resistant and dust-resistant metallurgical composition according to the invention can be defined as a composition containing at least about 80 percent by weight of iron-based powder; at least one alloying powder; and about 0.05 to about 2 percent by weight of a partially melted and subsequently solidified binding/lubricating combination adhering the alloying powder particles to the iron or iron-based powder particles.

Low molecular polyethylene waxes have been mentioned in connection with iron-based metal powders for the PM-industry in e.g. the U.S. Pat. No. 6,605,251 (Vidarsson) wherein it is disclosed that polyethylene waxes can be used as lubricants in warm or cold compaction of iron or iron based powders. When used in warm compaction the mixture including the polyethylene wax is heated to a temperature below the melting point of the polyethylene wax before compaction. The U.S. Pat. No. 6,602,315 (Hendrickson) and the related U.S. Pat. No. 6,280,683 (Hendrickson) disclose the use of low molecular polyethylene wax in bonded mixtures. The bonding effect is achieved by the wax at an elevated temperature which is below the melting point of the wax. The illustrating examples which concern iron or iron-based powders indicate that none of the samples exhibited flow. Furthermore the U.S. Pat. No. 6,533,836 (Uenosono) and U.S. Pat. No. 6,464,751 (Uenosono) disclose a free lubricant of low molecular polyethylene wax and ethylenebis-stearamide in combination with a binder which comprises at least one member selected from the group consisting of stearic acid, oleamide, stearamide, a melted mixture of stearamide and ethylenebis(stearamide) and ethylenebis (stearamide). The binder may also comprise zinc stearate and at least one member selected form the group consisting of oleic acid, spindle oil and turbine oil.

According to the present invention it is also preferred that the starting mix in addition to the iron or iron-based powder, the alloying powder and the polyethylene wax and the ethylene bisstearamide also includes a fatty acid, preferably a fatty acid having 10-22 C atoms. Examples of such acids are oleic acid, stearic acid and palmitic acid. The amount of the fatty acid is normally 0.005-0.15, preferably 0.010-0.08 and most preferably 0.015-0.07% calculated on the total weight of the powder composition. Fatty acid contents below 0.005 make it difficult to achieve an even distribution of the fatty acid. If the content is higher than 0.15 there is a considerable risk that the flow will deteriorate.

It is furthermore preferred that a flow agent of the type disclosed in the U.S. Pat. No. 5,782,954 (Luk) is included in the composition after the bonding has been completed. Preferably this flow agent is silicon oxide, most preferably silicon dioxide having an average particle size of below about 40, preferably from about 1-35 nanometers and it is used in an amount from about 0.005 to about 2, preferably 0.01-1 percent by weight, most preferably from 0.025 to 0.5 percent by weight of the total composition. Other metals that can be used as flow agents in either its metal or metaloxide forms include aluminium, copper, iron, nickel, titanium, gold, silver, platinum, palladium, bismuth, cobalt, manganese, lead, tin, vanadium, yttrium, niobium, tungsten and zirconium with a particle size of less than 200 nm.

The process for preparing the new powder composition includes the steps of mixing and heating a mix of an iron or iron-based powder, an alloying element powder, ethylene-bisstearamide and a pulverulent polyethyelene wax and optionally a fatty acid to a temperature above the melting point of the polyethylene wax, and below the melting point of EBS cooling the obtained mixture to a temperature below the melting point of the polyethyelene wax for a period of time sufficient to solidify the polyethyelene wax and bind the particles of the alloying element to the iron-containing particles in order to form aggregate particles, and optionally, mixing a pulverulent flow agent having a particle size below 200 nanometers, preferably below 40 nanometers, with the obtained mixture in an amount between 0.005 to about 2% by weight of the composition. The heating is suitably performed at a temperature between 70 and 150° C. for a period between 1 and 60 minutes.

The invention is further illustrated by the following non limiting examples, wherein the following ingredients and methods were used:

Iron powder-AHC 100.29 from Höganäs AB (Sweden)

Graphite uf4 from Kropfmuhl

Polyethylene wax 400, 500, 655, 750 and 1000 from Baker Petrolite (USA).

Ethylene bisstearamide (EBS) available as Licowax™) from Clariant (Germany)

The stearic acid is available from Faci (Italy)

Aerosil is available from Degussa AG (Germany).

The flow was measured according to ISO 4490.

The apparent density was measured according to ISO 3923.

The Ejection Energy was evaluated in an instrumented 125 tons hydraulic uniaxial laboratory press. Force and displacement are registered during ejection of the compact. Ejection energy is calculated by integrating the force with respect to the displacement of the ejected part. Ejection energy is expressed as energy per envelope surface area.

Dusting was measured by subjecting 5 grams of the sample to a flow of air of 1.7 liter/minutes, particles less then 10 microns transported by the air stream were counted by a measuring instrument Dust Track Aerosol Monitor model 8520. Dusting is expressed as $mg/m^3$. The part bonded graphite and lubricant was measured by an instrument Roller Air Analyzer or Roller particle size Analyzer from Aminco. The instrument is an air classifier, which separates material by diameter and density. 50 grams of sample was used. The fraction of banded graphite is calculated by comparing the content of graphite before and after the air classification. Bonding in this case is expressed as % bonded graphite.

EXAMPLE 1

Mixtures including iron powder, 0.5% by weight of graphite and 0.8% by weight of a binding/lubricating combination of polyethylene wax with different weight average molecular weight and ethylene bisstearamide, according to table 1, and 0.05% of stearic acid were thoroughly heated and mixed at temperature above the melting point of the polyethylene wax but below the melting point of the ethylene bisstearamide. The mixtures were then allowed to cool in order to obtain a bonded powder mixture wherein the graphite particles were bonded to the iron particles. During cooling 0.06% of an inorganic particulate flow agent was added. Powder properties such as flow, apparent density and dusting were measured. In order to measure the lubricating properties rings with outer diameter of 55 mm, inner diameter of 45 mm and a height of 10 mm were compacted at three different compaction pressures and the energy needed in order to eject the body from the mould after compaction. i.e. ejection energy, were measured.

TABLE 1

| Mixture | binding/lubricating combination |
|---|---|
| 1 | 75% EBS/25% Polywax 400 |
| 2 | 75% EBS/25% Polywax 500 |
| 3 | 75% EBS/25% Polywax 655 |
| 4 | 75% EBS/25% Polywax 750 |
| 5 | 75% EBS/25% Polywax 1000 |

EXAMPLE 2

Mixtures including iron powder, 0.5% by weight of graphite and 0.8% by weight of a binding/lubricating combination of polyethylene wax and ethylene bisstearamide in different proportions, and 0.05% of stearic acid, according to table 2, were thoroughly heated and mixed at temperature above the melting point of the polyethylene wax but below the melting point of the ethylene bisstearamide. The mixtures were then allowed to cool in order to obtain a bonded powder mixture wherein the graphite particles were bonded to the iron particles. During cooling 0.06% of an inorganic particulate flow agent was added. Powder properties such as flow, apparent density and dusting were measured. In order to measure the lubricating properties rings with outer diameter of 55 mm, inner diameter of 45 mm and a height of 10 mm were compacted at three different compaction pressures and the energy needed in order to eject the body from the mould after compaction, i.e. ejection energy, were measured.

TABLE 2

| Mixture | binding/lubricating combination |
|---|---|
| 6 | 90% EBS/10% Polywax 655 |
| 7 | 75% EBS/25% Polywax 655 |
| 8 | 60% EBS/40% Polywax 655 |
| 9 | 40% EBS/60% Polywax 655 |
| 10 | 100% Polywax 655 |

EXAMPLE 3—COMPARATIVE EXAMPLE

Two mixtures including iron powder, 0.5% by weight of graphite and 0.8% by weight of ethylene bisstearamide but with no polyethylene wax were prepared. Mixture no 11 including 0.05% by weight of stearic acid was thoroughly heated and mixed at temperature above the melting point of the ethylene bisstearamide. The mixture was then allowed to cool in order to obtain a bonded powder mixture wherein the graphite particles were bonded to the iron particles. During cooling 0.06% of an inorganic particulate flow agent was added. Mixture no 12 were thoroughly mixed without heating. Powder properties such as flow, apparent density and dusting were measured. In order to measure the lubricating properties rings with outer diameter of 55 mm, inner diameter of 45 mm and a height of 10 mm were compacted at three different compaction pressures and the energy needed in order to eject the body from the mould after compaction, i.e. ejection energy, were measured.

As can be seen from table 4 best combination of AD, flow, bonding and lubrication properties for the powder metallurgical composition containing a binding/lubricating combination including the polyethylene wax and ethylene bis stearamide is achieved when the mean molecular weight of the polyethylene wax is between 500 and 750, the content of polyethylene wax is between 10-90% and the content of ethylene bis stearamide is between 90 and 10% in the binding/lubricating combination.

As can be seen from the following Table 4, best combination of the AD, flow, bonding and lubrication properties for the powder metallurgical composition containing the binding/lubricating combination including polyethylene wax and ethylene bis-stearamide is achieved when the mean molecular weight of the polyethylene wax is between 500 and 750, the content of polyethylene wax is between 10-90%, preferably between 20-80%, and the content of ethylene bis-stearamide is between 90-10%, preferably between 80-20%, of the binding/lubricating combination.

TABLE 4

| Mixture no | AD g/cm3 | Flow sek | Dust mg/m3 | Bonding % |
|---|---|---|---|---|
| 1 | 3.03 | 27.5 | 26 | 97.8 |
| 2 | 3.09 | 26.5 | 23 | 97.0 |
| 3 | 3.13 | 24.3 | 46 | 100.0 |
| 4 | 3.13 | 24.8 | 67 | 98.6 |
| 5 | 3.17 | 24.3 | 36 | 100.0 |
| 6 | 3.07 | 24.7 | 112 | 97.3 |
| 7 | 3.13 | 24.3 | 46 | 100.0 |
| 8 | 3.16 | 24.1 | 29 | 99.2 |
| 9 | 3.23 | 22.9 | 22 | 100.0 |
| 10 | 2.92 | 25.8 | 31 | 100 |
| 11 | 3.28 | 24.4 | 39 | 99.8 |
| 12 | 2.98 | 33.5 | 288 | 54.9 |

TABLE 4

| Mixture no | GD 400 MPa g/cm3 | GD 600 MPa g/cm3 | GD 800 MPa g/cm3 |
|---|---|---|---|
| 1 | 6.75 | 7.10 | 7.23 |
| 2 | 6.74 | 7.09 | 7.22 |
| 3 | 6.70 | 7.06 | 7.20 |
| 4 | 6.70 | 7.05 | 7.19 |
| 5 | 6.69 | 7.04 | 7.19 |
| 6 | 6.69 | 7.04 | 7.19 |
| 7 | 6.70 | 7.06 | 7.20 |
| 8 | 6.69 | 7.06 | 7.20 |
| 9 | 6.67 | 7.04 | 7.18 |
| 10 | 6.69 | 7.03 | 7.16 |
| 11 | 6.63 | 7.00 | 7.17 |
| 12 | 6.66 | 7.04 | 7.18 |

TABLE 4

| Mixture no | Ejection Energy 400 MPa $J/cm^2$ | Ejection Energy 600 MPa $J/cm^2$ | Ejection Energy 800 MPa $J/cm^2$ |
|---|---|---|---|
| 1 | 20.0 | 28.9 | 31.4 |
| 2 | 19.8 | 29.2 | 31.5 |
| 3 | 20.1 | 25.9 | 32.4 |
| 4 | 20.1 | 30.1 | 32.5 |
| 5 | 20.1 | 30.5 | 34.0 |
| 6 | 20.1 | 30.6 | 33.2 |
| 7 | 20.1 | 25.9 | 32.4 |
| 8 | 19.4 | 29.3 | 33.3 |
| 9 | 18.9 | 27.3 | 31.5 |
| 10 | 23.6 | 31.0 | 34.9 |
| 11 | 20.1 | 31.6 | 38.7 |
| 12 | 19.3 | 29.0 | 33.5 |

The invention claimed is:

1. An improved segregation-resistant and dust-resistant metallurgical composition for making compacted parts, comprising:

(a) at least about 80 percent by weight of an iron or iron-based powder;

(b) at least one alloying element powder; and (c) about 0.05 to about 2 percent by weight of a binding/lubricating combination of polyethylene wax and ethylene bis-stearamide, the polyethylene wax having a weight average molecular weight below about 1000 and a melting point below that of ethylene bis-stearamide, and being present in amount between 10 and 90% by weight of the binding/lubricating combination, wherein the particles of the iron or iron-based powder are coated with a layer of the polyethylene wax binding particles of the alloying element(s) and particles of the ethylene bis-stearamide.

2. Composition according to claim 1, wherein the polyethylene wax has a weight average molecular weight between 400 and 800.

3. Composition according to claim 1, wherein the binding/lubricating combination is made up by 20-70% by weight of the polyethylene wax and 80-30% by weight of the ethylene bis-stearamide.

4. Composition according to claim 1, wherein the binding/lubricating combination is present in an amount of 0.5-1.5% by weight of the total composition.

5. Composition according to claim 1, further including a fatty acid in an amount of 0.005-0.15 by weight of the composition.

6. Composition according to claim 5, wherein the fatty acid is stearic acid.

7. Composition according to claim 1, further including a flow agent in an amount of 0.01-1 percent by weight of the total composition.

8. Composition according to claim 1, wherein the flow agent is silicon dioxide.

9. Method of preparing an improved segregation-resistant and dust-resistant metallurgical composition containing alloying powder bound to iron-based powder comprising the steps of mixing and heating an iron or iron-based powder, an alloying element powder, ethylene bis-stearamide and a pulverulent polyethylene wax and optionally a fatty acid to a temperature above the melting point of the polyethylene wax and below the melting point of the ethylene bis-stearamide cooling the obtained mixture to a temperature below the melting point of the polyethylene wax for a period of time sufficient to solidify the polyethylene wax and bind the particles of the alloying element to the iron-containing particles in order to form aggregate particles, and optionally mixing a pulverulent flow agent having a particle size below 200 nanometers with the obtained mixture in an amount between 0.005 to about 2% by weight of the composition.

10. Method according to claim 9, wherein the mixture is heated to a temperature between 70 and 150° C. for a period between 1 and 60 minutes.

11. Method according to claim 9, wherein the polyethylene wax has a weight average molecular weight between 400 and 800.

12. Method according to claim 9, wherein the ethylene bis-stearamide and the polyethylene wax forms a binding/lubricating combination made up by 20-70% by weight of the polyethylene wax and 80-30% by weight of the ethylene bis-stearamide.

13. Composition according to claim 2, wherein the binding/lubricating combination is made up by 20-70% by weight of the polyethyelene wax and 80-30% by weight of the ethylene bis-stearamide.

14. Method according to claim 9, wherein the ethylene bis-stearamide and the polyethylene wax jointly are present in an amount of 0.5-1.5% by weight of the total composition.

15. Method according to claim 9, wherein the fatty acid is included in an amount of 0.005-0.15% by weight of the composition.

16. Composition according to claim 1, further including a fatty acid in an amount of 0.010-0.08% by weight of the composition.

17. Composition according to claim 1, further including a fatty acid in an amount of 0.015-0.07% by weight of the composition.

18. Composition according to claim 1, further including a flow agent in an amount of 0.025-0.5 percent by weight of the total composition.

19. Method according to claim 9, wherein said pulverulent flow agent has a particle size below 40 nanometers.

20. An improved segregation-resistant and dust-resistant metallurgical composition for making compacted parts, comprising:

(a) at least about 80 percent by weight of an iron or iron-based powder;

(b) at least one alloying element powder; and (c) about 0.05 to about 2 percent by weight of a binding/lubricating combination of polyethylene wax and ethylene bis-stearamide, the polyethylene wax having a weight average molecular weight below about 1000 and a melting point below that of ethylene bis-stearamide, and being present in amount between 10 and 90% by weight of the binding/lubricating combination, wherein a mixture of the iron or iron-based powder, alloying element powder, ethylene bis-stearamide and polyethylene wax having been heated to a temperature above the melting point of the polyethylene wax and below the melting point of the ethylene bis-stearamide and cooled to a temperature below the melting point of the polyethylene wax for a period of time sufficient to solidify the polyethylene wax.

* * * * *